US006216568B1

(12) United States Patent
Breiling

(10) Patent No.: US 6,216,568 B1
(45) Date of Patent: Apr. 17, 2001

(54) PLIERS FOR REMOVING KNOCKOUTS

(76) Inventor: Gerald P. Breiling, P.O. Box 681343, Schaumburg, IL (US) 60168

( * ) Notice: Subject to any disclaimer, the term of this patent is extended or adjusted under 35 U.S.C. 154(b) by 0 days.

(21) Appl. No.: 09/137,758

(22) Filed: Aug. 20, 1998

(51) Int. Cl.[7] ..... B25B 7/02

(52) U.S. Cl. ..... 81/426; 81/418; 29/268; 72/379.2

(58) Field of Search ..... 81/426, 424.5, 81/418; 29/764, 268; 72/379.2, 387, 409

(56) References Cited

U.S. PATENT DOCUMENTS

| | | | | |
|---|---|---|---|---|
| 354,313 | * | 12/1886 | Galloway | 81/424.5 |
| 1,585,903 | * | 5/1926 | McIntyre | 81/426 |
| 1,664,081 | * | 3/1928 | Means | 81/426 |
| 2,948,171 | * | 8/1960 | Lucibello | 81/418 |
| 3,357,460 | * | 12/1967 | Gawura | 81/426 |
| 4,014,226 | * | 3/1977 | Karamarkovich | 81/426 |
| 4,890,519 | | 1/1990 | Le Duc . | |
| 4,901,609 | | 2/1990 | Crum . | |
| 5,011,491 | * | 4/1991 | Boenko et al. | 81/418 |
| 5,058,414 | * | 10/1991 | Hayes | 81/426 |
| 5,134,908 | | 8/1992 | Fisher . | |
| 5,283,936 | * | 2/1994 | Pickles et al. | 81/426 |
| 5,676,029 | | 10/1997 | Putsch . | |

* cited by examiner

*Primary Examiner*—David A. Scherbel
*Assistant Examiner*—Joni B. Danganan
(74) *Attorney, Agent, or Firm*—Thomas C. McDonough; Michael A. Carrillo

(57) ABSTRACT

A set of pliers for easily and quickly removing concentric or standard knockouts from steel outlet boxes and the like. The subject tool is a set of pliers, comprising a first arm having a first end and second end and a second arm having a first end and second end, where the first arm and the second arm are pivotally connected with respect to one another by an interconnecting mechanism located between the first and second ends thereof. The first arm forms a first jaw located above the interconnecting mechanism of the first arm and the second arm forms an opposing, second jaw located above the interconnecting mechanism. The first jaw includes a first projection that extends from an area between the first end of the first arm and the interconnecting mechanism. The second jaw includes a second projection that extends from the end of the second arm. The first projection abuts the second jaw and the second projection abuts the first jaw. Thus, the first and second projections do not touch. By strategically placing one of the projections within the circumference of a knockout located on a junction box and the other projection along the periphery of said knockout or the junction box frame and squeezing the first and second arm, at least one end of the knockout can be easily and quickly fractured.

7 Claims, 6 Drawing Sheets

PLIERS FOR REMOVING KNOCKOUTS

BACKGROUND OF THF INVENTION

The present invention relates generally to a novel set of pliers and to a method for using said pliers to remove knockouts from steel outlet boxes, electrical conduit boxes or junction boxes and the like.

In the construction industry, it is widely known to use steel outlet boxes or junction boxes to serve as the point of origin, termination or coupling for electrical wiring, conduit and the like. The junction boxes are usually comprised of four side walls and a back wall. Since the direction of entry to the junction boxes varies, the side walls contain a plurality of removable knockouts. Further, to customize the placement of such metal boxes while also maintaining their integrity, the knockouts are only removed from the sides of the junction boxes which will receive wiring, conduit or the like. Normally the knockouts are coined or cut into the metal side walls of the respective junction box except for a tab, where the tab primarily secures the knockouts to the junction box.

The normal practice in the industry for removing knockouts is to place the head of a screwdriver within the circumference of a knockout and to strike the screwdriver with a blunt object, such as a hammer. This normally produces a force in one direction that fractures a portion of the knockout thereby causing the knockout to bend in relation to the supporting side wall of the junction box. The head of the screwdriver can then be used to further pry or bend the knockout in relation to the supporting side wall. With one side of the knockout now accessible, a pair of pliers or other gripping means can be used to secure the knockout and bend and twist the knockout until the remaining portion of the knockout is fractured thereby releasing the knockout. This process is time consuming and has a potential for damaging the junction box.

Also, it is sometimes the case that modification of junction boxes that are already installed will be performed. Under the normal practice in the industry, this may be problematic because fracturing the concentric knockout with a hammer and screwdriver requires adequate clearance and installed junction boxes may be located in tightly fitted areas.

The pliers that are currently available do not provide an adjustable plier jaw structure capable of quickly and easily removing knockouts. For example, as it is known in the art, pliers typically include two plier arms which are pivotally and adjustably interconnected, where the two plier arms further include opposing jaw portions that abut one another. As is further understood by those skilled in the art, the abutting portions of the pliers jaw allows the pliers to grip objects of varying sizes. This is typically performed by pivoting the plier arms in a manner to cause the two opposed jaw portions to form an open jaw, placing a particular object within the jaws, and then pivoting the plier arms in an opposite manner to cause the two opposed jaw portions to close on the object. The plier arms can also be adjusted to provide a larger or smaller jaw opening. An example of means for adjusting the size of the jaw opening are more clearly disclosed in U.S. Pat. No. 5,134,908. This patent discloses several different embodiments for pivotally and adjustably interconnecting two plier arms. Specifically, the jaws can be selectively adjusted to a variety of preset positions. Further examples of adjustable pliers may also be seen in U.S. Pat. No. 4,890,519, U.S. Pat. No. 4,901,609 and U.S. Pat. No. 5,676,029.

While the adjustable pliers shown in the prior art work well for their intended purpose and for removing knockouts once they have been fractured, they are not capable of quickly and easily fracturing the knockouts. In fact, this is why pliers are not currently used in the process of fracturing knockouts. This results from the fact that pliers are designed to provide force at a single point, and in primarily, equal and opposite directions. Thus, such pliers are not capable of providing the torque necessary to shear or fracture the knockout.

As a result of these noted deficiencies in the prior art, it is an object of the present invention to provide a set of pliers having an improved means for quickly and easily removing knockouts and improved means for providing opposing and offset forces which produce a greater quantity of sheer force upon a concentric or standard knockout.

SUMMARY OF THE INVENTION

The subject invention overcomes the deficiencies in the prior art by providing a set of pliers capable of providing two opposing and offset forces upon concentric and disc knockouts with a single tool and a method for removing said knockouts from steel outlet boxes, electrical conduit boxes or junction boxes and the like. This includes the various elements of the invention which act in conjunction with one another to quickly and easily remove knockouts. For example, the pliers include a first arm having a first end and a second end and a second arm having a first end and a second end, where the first arm and the second arm are pivotally connected with respect to each other by an interconnecting mechanism located between the first and second ends thereof. The first arm forms a first jaw located above the interconnecting mechanism of the first arm and the second arm forms an opposing, second jaw located above the interconnecting mechanism of the second arm. The first jaw includes a first projection that extends from an area between the end of the first jaw portion and the interconnecting mechanism. The second jaw of the second arm includes a second projection that extends from the end of the second jaw. The end of the first projection abuts the second jaw and the end of the second projection abuts the first jaw. Thus, the first and second projection are offset from one another so that they do not touch. By strategically placing one of the projections within the circumference of a knockout located on a junction box and the other projection along the outer periphery of said knockout and squeezing the first and second arms, opposing and offset forces are applied to the knockout and junction box frame, respectively, and at least one end of the knockout is easily and quickly fractured. The pliers in accordance with this invention could also include an adjustable interconnecting mechanism and could be used for a wide range of other purposes. Therefore, this invention is not limited to the usages described herein.

The foregoing features and advantages of the present invention will be apparent from the following more particular description of the invention. The accompanying drawings, listed hereinbelow, are useful in explaining the invention.

DETAILED DESCRIPTION OF THE INVENTION

Figures 1, 2:
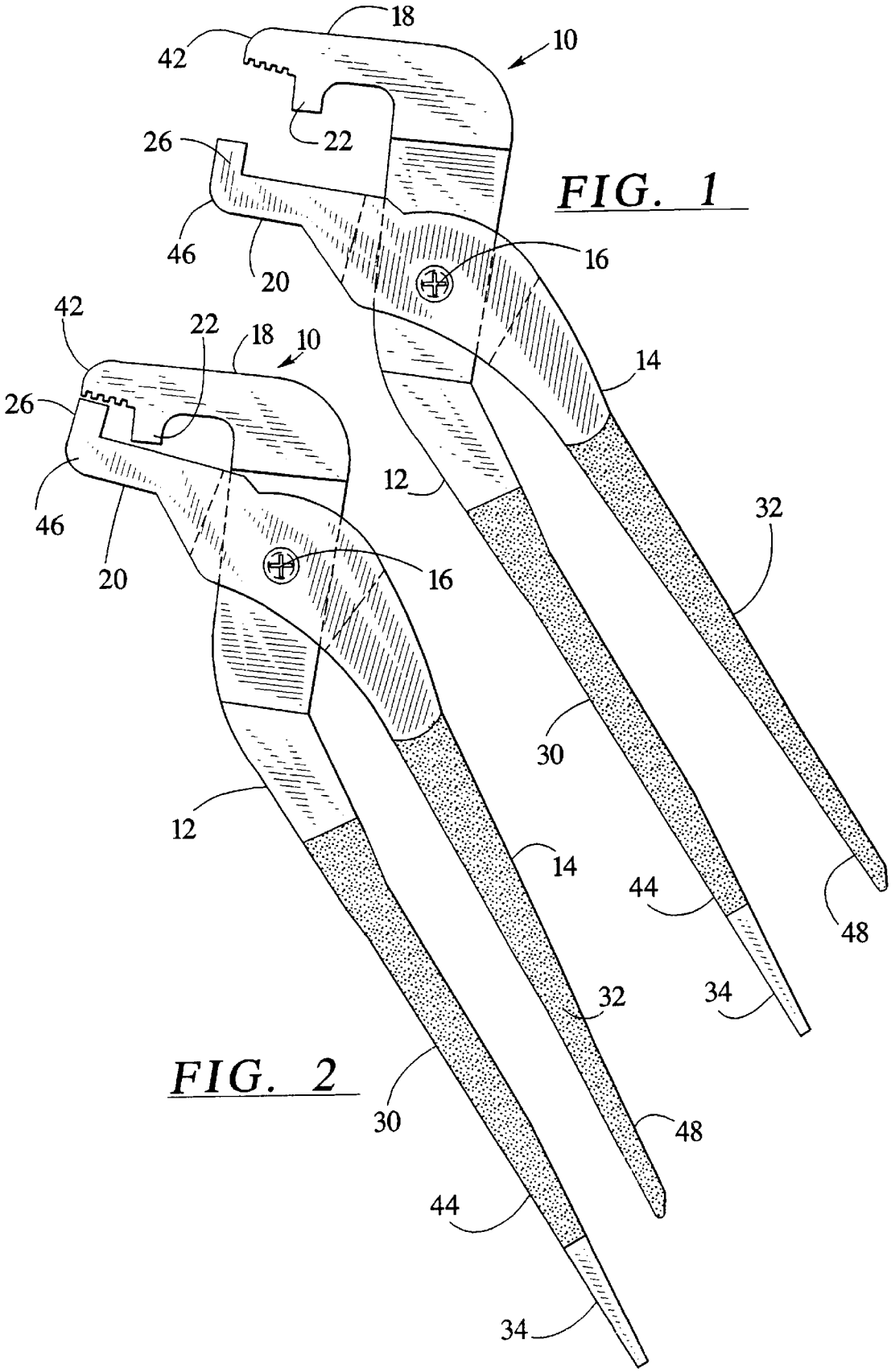
FIG. 1 is a front view of the pliers of the present invention in an open position.
FIG. 2 is a front view of said pliers in a closed position.

FIG. 1 shows a front view of the inventive pliers 10. Briefly, pliers 10 includes a first arm 12 having a first end 42 and a second end 44 and a second arm 14 having a first end 46 and a second end 48. The first arm 12 and the second arm 14 are pivotally connected to one another by an interconnecting mechanism 16, which can be adjustable as is known in the art. Arms 12 and 14 may be comprised of steel, aluminum, or any other solid material capable of being shaped into pliers and withstanding a high level of force. First arm 12 forms a first jaw 18 above the interconnecting mechanism 16 and second arm 14 also forms an opposing second jaw 20 above the interconnecting mechanism 16. First jaw 18 includes a first projection 22 located between first end 42 of first arm 12 and interconnecting mechanism 16 and extending from first jaw 18 toward second jaw 20. Second jaw 20 includes a second projection 26 that extends from first end 46 of second arm 14 toward first jaw 18. Projections 22 and 26 are offset from each other and therefore do not touch one another.

As shown in FIG. 2, when pliers 10 is in a closed position, projections 22 and 26 abut opposing jaws 20 and 18, respectively. As will be discussed below, such positioning of first projection 22 and second projection 26 allows pliers 10 to apply a greater quantity of sheer force, at a point between projections 22 and 26, on a length of material which extends between first projection 22 and second projection 26. First arm 12 and second arm 14 also include first handle 30 and second handle 32, respectively. As discussed below, arms 12 and 14 are pivotally connected in a manner that allows the movement of first handle 30 toward second handle 32 to cause an equal movement in first jaw 18 toward second jaw 20, thereby forming an open and closed position for the pliers 10, as shown in FIGS. 1 and 2. In addition, first handle 30 can be longer than second handle 32 thereby forming a prying means 34.

Figure 3:
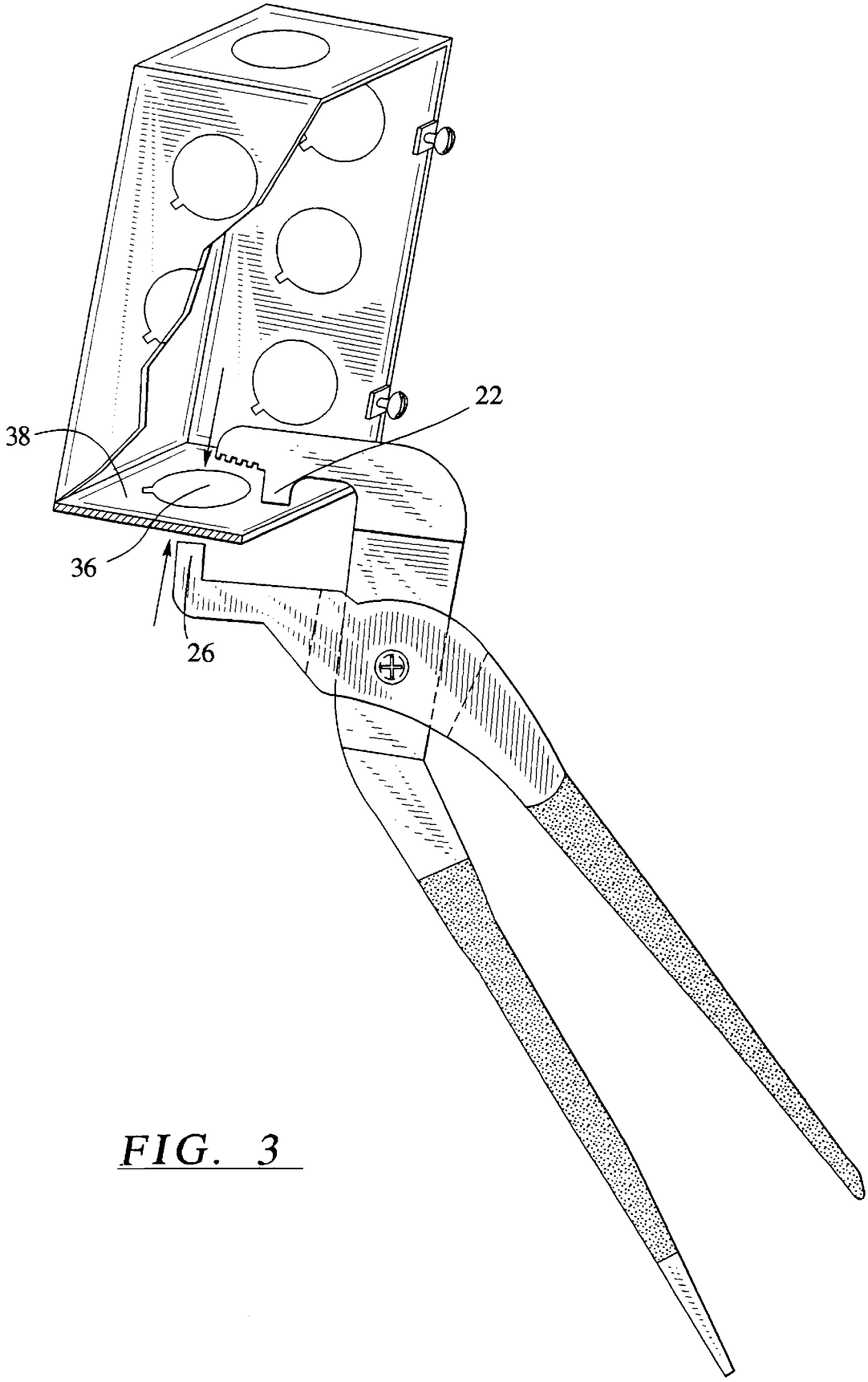
FIG. 3 is a perspective view of said pliers engaging an outlet box and more particularly a concentric or standard knockout.

Refer now to FIG. 3, which shows pliers 10 engaging a steel outlet box or junction box. First projection 26 can be placed within the circumference of a concentric knockout or a standard knockout 36, while second projection 22 can be placed on a side wall 38 of the box 40. By closing the jaw of pliers 10, i.e., moving the first handle 30 toward the second handle 32, first projection 22 and second projection 26 apply force to the side wall 38 and the knockout 36 in opposite and offset directions (indicated by the arrow tipped lines adjacent the projections and normal to the side wall). This applies sheer force in two opposed directions with regard to knockout 36 thereby causing said knockout 36 to be fractured from the side wall 38.

Figure 4:
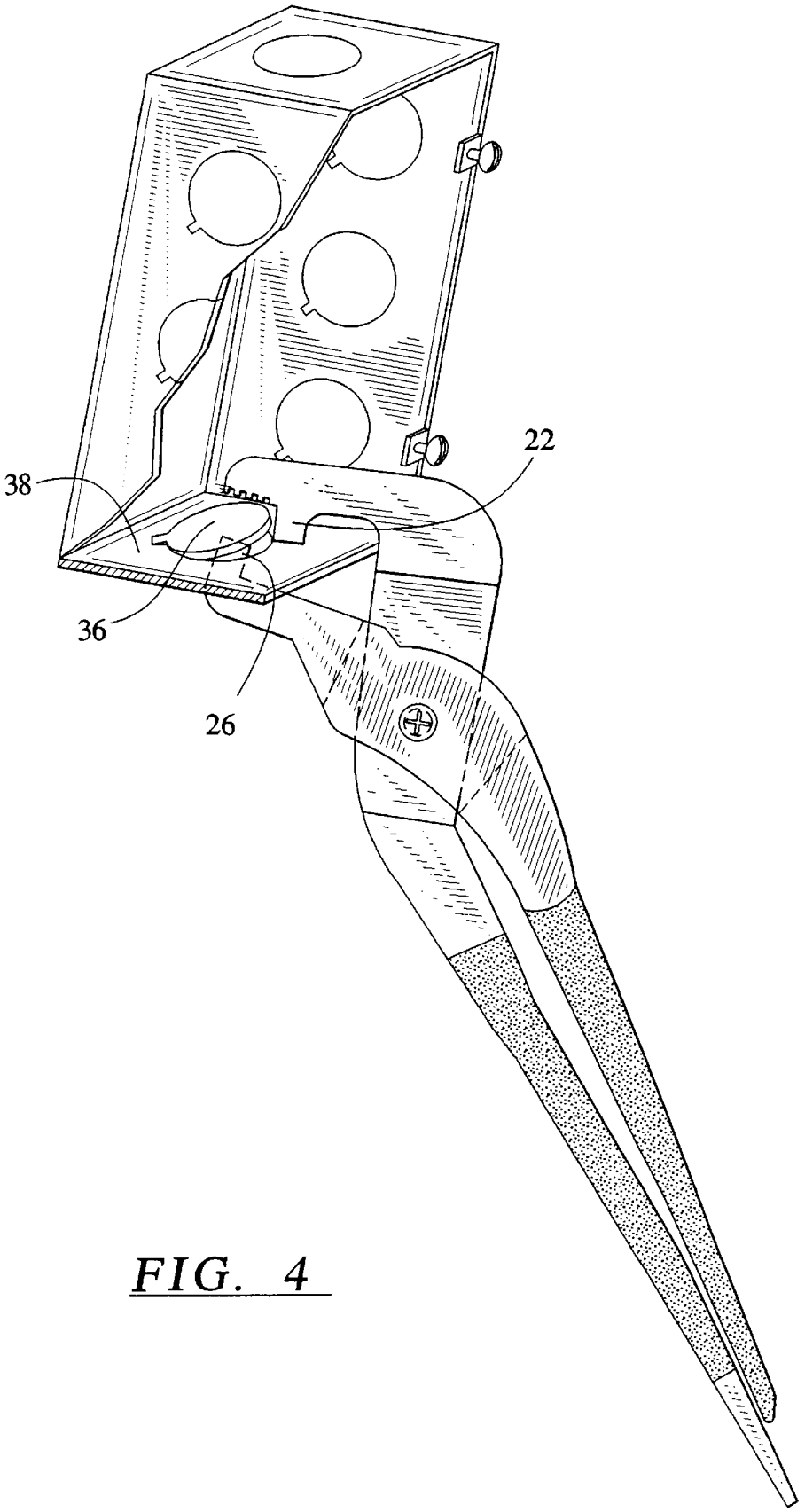
FIG. 4 is a perspective view of an outlet box with a fractured knockout.
Figure 5:
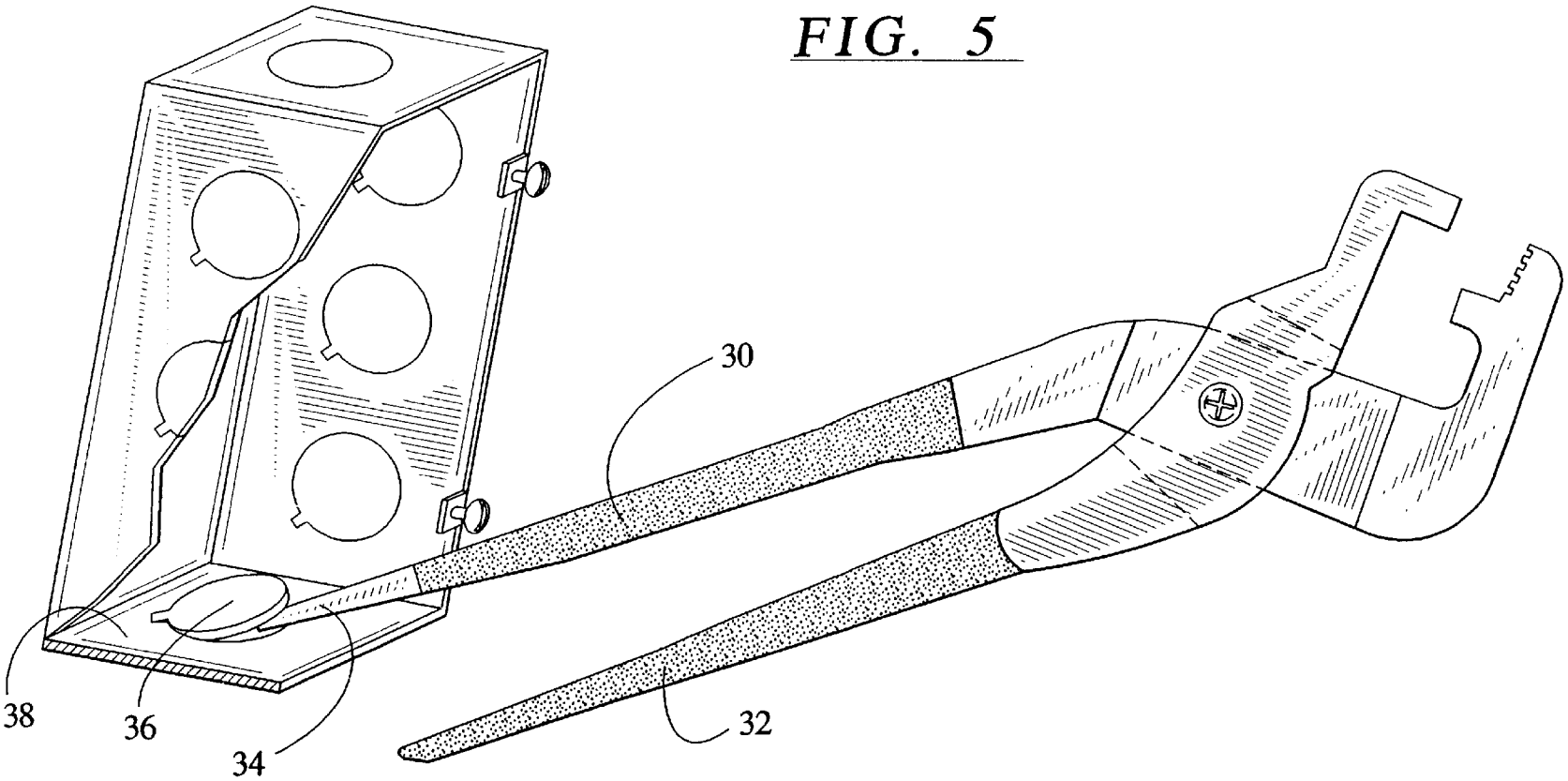
FIG. 5 is a perspective view of the prying means interacting with the fractured knockout shown in FIG. 4.
Figure 6:
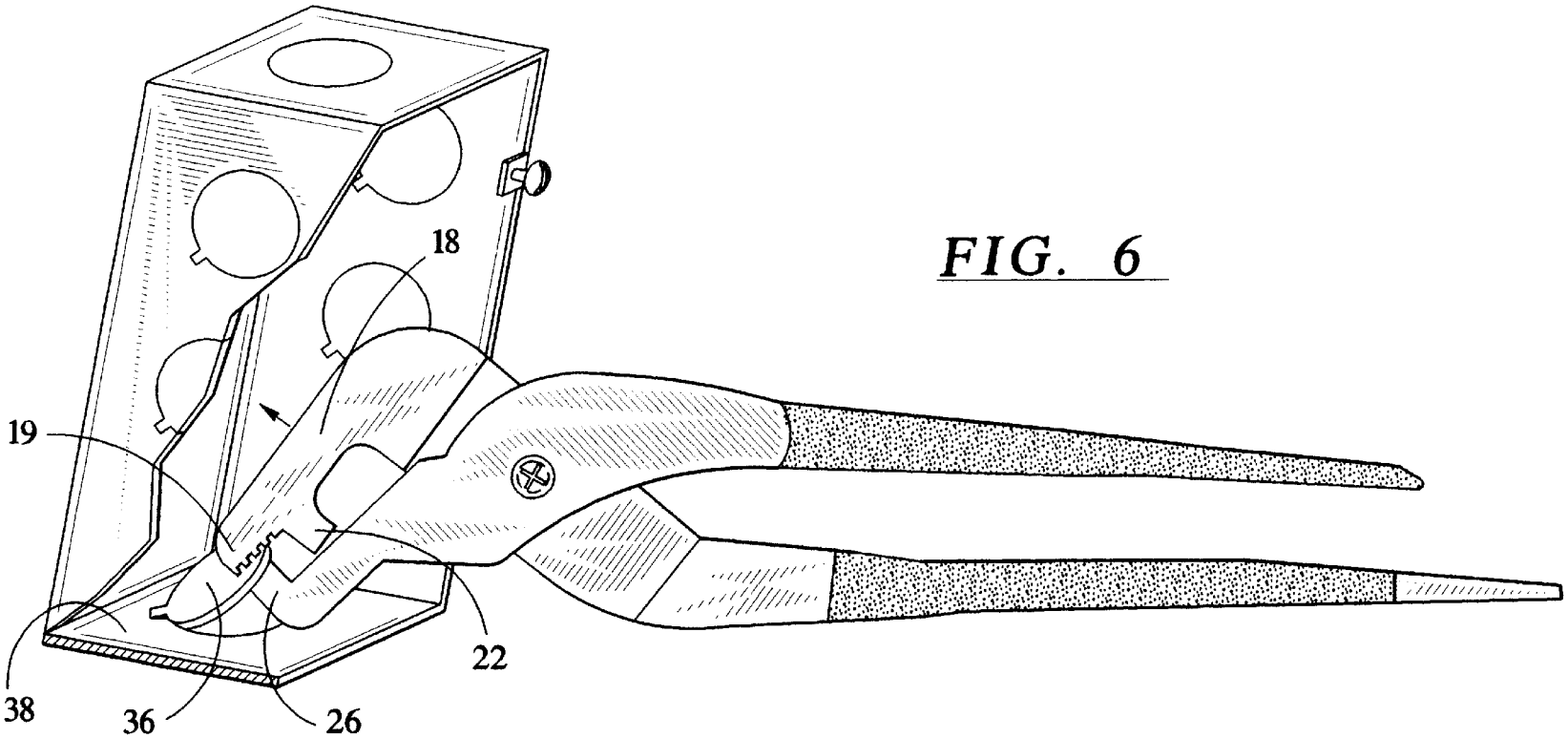
FIG. 6 is a perspective view of the pliers securing the knockout.

Refer now to FIGS. 4–6 which show the pliers 10 interacting with the fractured knockout 36. As shown in FIG. 5, the prying means 34 of the first handle 30 is positioned between the opening (created by fracturing the knockout) between the knockout 36 and side wall 38. Because prying means 34 can be located at the end of first handle 30 by forming first handle 30 to be longer than second handle 32. This increased length provides the prying means 34 with greater leverage. As shown in FIG. 5, by prying knockout 36, the opening between knockout 36 and side wall 38 is expanded. As shown further in FIG. 6, pliers 10 are capable of grabbing knockout 36 to complete removal of said knockout 36, similar in function to the prior art pliers. Specifically, knockout 36 is positioned between the second projection 26 and the end 19 of the first jaw 18, and then first handle 30 is moved toward second handle 32 thereby securing knockout 36. After pliers 10 have secured knockout 36, pliers 10 can be used to twist and turn the knockout until any portion of the knockout 36 which is still attached becomes fractured.

Figure 8:
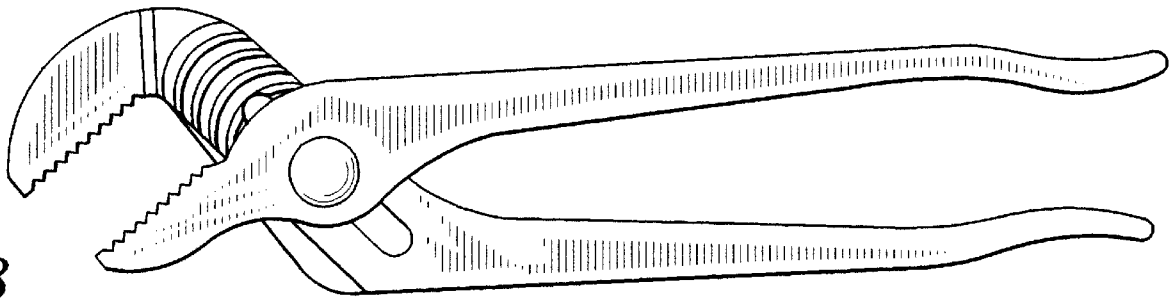
FIG. 8 is a front view of prior art pliers showing adjustable interconnecting means similar to those provided in the second embodiment of the inventive pliers disclosed herein.
Figure 7:
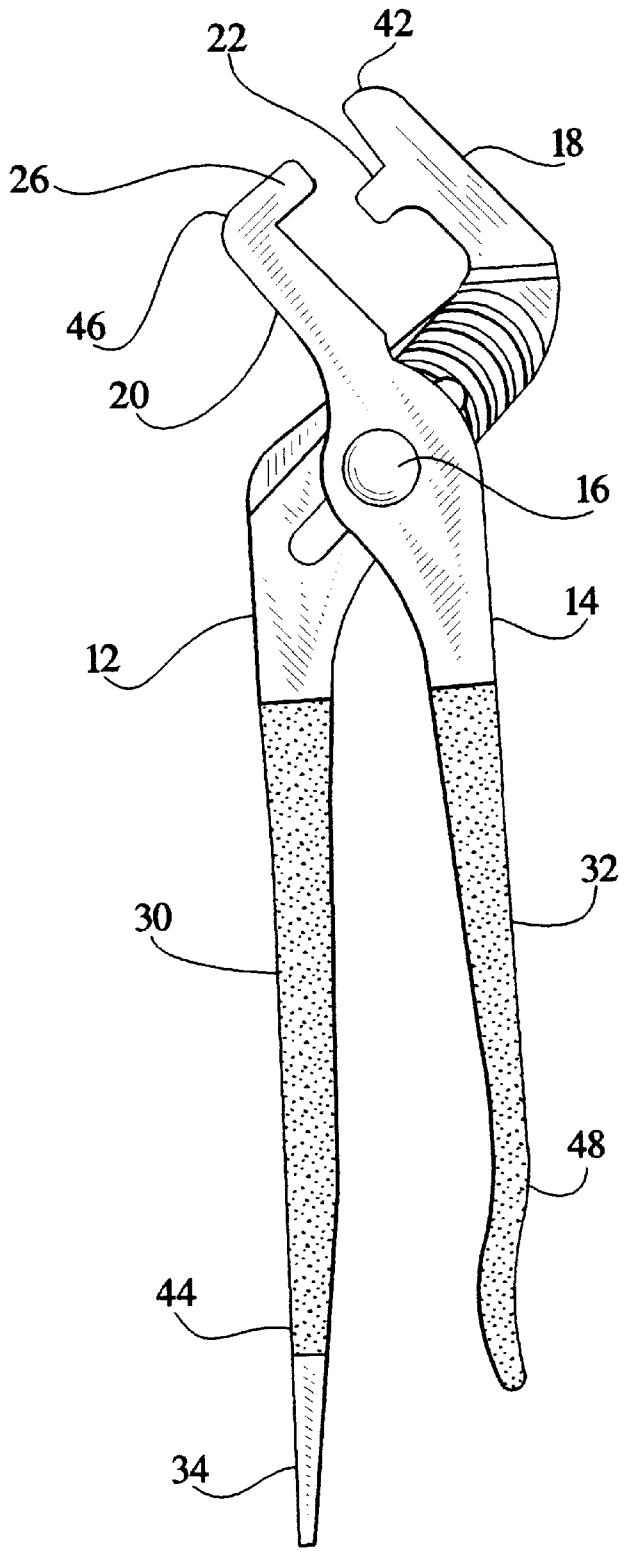
FIG. 7 is front view of the second embodiment of the pliers claimed in the present invention in an open position.

Refer now to FIG. 7 which shows a second embodiment of pliers 10. Specifically, pliers 10 comprise an adjustable interconnecting mechanism 16. The interconnecting mechanism 16 allows arms 12 and 14 to be adjusted in relation to one another which in turn allows the distance between first projection 22 and second projection 26 to be varied. The manner for providing adjustable pliers is well known in the art. For example, FIG. 8 shows prior art pliers which disclose an adjustable pair of pliers utilizing a tongue and groove arrangement like the adjustable interconnecting mechanism provided in the second embodiment of the subject application shown in FIG. 7.

While the invention has been particularly shown and described with reference to a particular embodiment thereof it will be understood by those skilled in the art that various changes in form and detail may be made therein without departing from the spirit and scope of the invention.

What it claimed is:

1. A method of fracturing a knockout from an outlet box with side walls and a back wall, where at least one of the side walls include removable knockouts, said method comprising the steps of:

providing a pair of pliers having a first arm and a second arm, where said first arm and said second arm cross with respect to each other and are pivotally connected with respect to one another by an interconnecting mechanism, and where the first arm and the second arm each have a first end and a second end, where the first end of the first arm forms a first jaw above the adjustable interconnecting mechanism and the first end of the second arm forms an opposing second jaw above the adjustable interconnecting mechanism, where the first jaw includes a first projection extending from an area between the end of the first jaw and the interconnecting mechanism and the second jaw includes a second projection extending from the end of the second jaw, and where the second projection abuts the first jaw and where the first projection abuts the second jaw, wherein the first projection does not touch the second projection and where the second end of the first arm forms a first handle and the second end of the second arm forms a second handle;

placing the first projection within the circumference of the knockout and the second projection outside of the circumference of the knockout; and moving the first handle toward the second handle thereby causing the first jaw and the second jaw to move toward each other whereby the first projection and the second projection provide a force in opposite directions on the knockout and the outlet box, respectively, thereby causing the knockout to be partially fractured from the outlet box.

2. A method according to claim 1, including the step of providing a pair of pliers where the first handle extends below the length of the second handle to form a prying means.

3. A method according to claim 2, including the step of inserting the prying means into an opening created between the partially removed knockout and the outlet box.

4. A method according to claim 3, including the step of prying the knockout away from the respective supporting side wall.

5. A method according to claim 4, including the step of placing the knockout between the first projection and the second jaw.

6. A method according to claim 5, including the step of moving the first handle toward the second handle thereby causing the first jaw and the second jaw to move toward each other whereby the first projection and the second jaw secure the knockout.

7. A method according claim 6, including the step of removing the knockout.

* * * * *